US012583707B2

(12) United States Patent
Wang

(10) Patent No.: US 12,583,707 B2
(45) Date of Patent: Mar. 24, 2026

(54) AUXILIARY DEVICE FOR REELS, AND REEL INCLUDING THE SAME

(71) Applicant: INTRADIN (HUZHOU) PRECISION TECHNOLOGY CO., LTD., Huzhou (CN)

(72) Inventor: Junliang Wang, Huzhou (CN)

(73) Assignee: INTRADIN (HUZHOU) PRECISION TECHNOLOGY CO., LTD., Huzhou City (CN)

( * ) Notice: Subject to any disclaimer, the term of this patent is extended or adjusted under 35 U.S.C. 154(b) by 135 days.

(21) Appl. No.: 18/781,225

(22) Filed: Jul. 23, 2024

(65) Prior Publication Data

US 2024/0375908 A1 Nov. 14, 2024

(30) Foreign Application Priority Data

May 27, 2024 (CN) ..... 202410661942.8

(51) Int. Cl.
*B65H 75/48* (2006.01)
*B65H 75/44* (2006.01)

(52) U.S. Cl.
CPC ..... *B65H 75/4442* (2013.01); *B65H 75/4428* (2013.01); *B65H 2701/33* (2013.01); *B65H 2701/34* (2013.01)

(58) Field of Classification Search
CPC ..... B65H 75/38; B65H 75/48; B65H 75/406; B65H 75/446; B65H 75/4428; B65H 75/4431; B65H 75/4442
See application file for complete search history.

(56) References Cited

U.S. PATENT DOCUMENTS 8,870,111 B2 * 10/2014 Kwankijpongsa ..... B65H 75/4431 242/378
2009/0039191 A1 * 2/2009 Yen ..... B65H 75/4431 242/378.2
2013/0119178 A1 * 5/2013 Masuda ..... B65H 75/48 242/378.1
2019/0256320 A1 * 8/2019 Hinojosa ..... H02G 11/02

FOREIGN PATENT DOCUMENTS

CN 205675917 U 11/2016
CN 107720458 B 1/2024

* cited by examiner

*Primary Examiner* — Sang K Kim

(57) ABSTRACT

A reel auxiliary device includes a shell, a locking mechanism, a decelerating mechanism and a transmission part. A first side of the shell is provided with a first groove, and a second side of the shell is provided with a second groove. The locking mechanism is arranged in the first groove, and is configured to control locking of a reel. The decelerating mechanism is arranged in the second groove. The shell, the locking mechanism, the decelerating mechanism, and the transmission part are connected through a connecting part, and the shell, the locking mechanism, the decelerating mechanism, the transmission part and the connecting part are arranged coaxially. A reel including the auxiliary device is further provided.

10 Claims, 16 Drawing Sheets

AUXILIARY DEVICE FOR REELS, AND REEL INCLUDING THE SAME

CROSS-REFERENCE TO RELATED APPLICATIONS

This application claims the benefit of priority from Chinese Patent Application No. 202410661942.8, filed on May 27, 2024. The content of the aforementioned application, including any intervening amendments thereto, is incorporated herein by reference in its entirety.

TECHNICAL FIELD

This application relates to reels, and more particularly to an auxiliary device for reels and a reel including the same.

BACKGROUND

A winding device for feeding and retracting tubular tools, also called a reel, has been widely used in our daily production and life.

For most of the existing reels, the to-be-wound tubular material cannot be stopped at any time as it is pulled, and it will be retracted immediately once the pull force disappears. If it is required to preventing the to-be-wound tubular material from automatically retracting, it is needed to provide an additional structure to lock the to-be-wound tubular material to keep it at a fixed length. During the retraction process, since the winding speed cannot be controlled, an end of the tubular material will swing irregularly, thereby causing damage to the surrounding operators and objects. In view of the single function and serious security risk, it is necessary to further optimize the existing reels to improve the user experience. In this regard, this application provides an auxiliary device for reels and a reel including the same to solve the above problems.

SUMMARY

In order to solve the problems in the prior art, this application provides an auxiliary device for reels, comprising:

a shell;

a locking mechanism;

a decelerating mechanism; and a transmission part;

wherein a first side of the shell is provided with a first groove, and a second side of the shell is provided with a second groove; a first cover is provided at an opening of the first groove, and a second cover is provided at an opening of the second groove; and the first cover is connected with the first side of the shell, and the second cover is connected with the second side of the shell;

the locking mechanism is arranged in the first groove, and is configured to control locking of a reel;

the decelerating mechanism is arranged in the second groove, and is configured to reduce a rotating speed of the reel;

the transmission part is arranged on a side of the first cover away from the first groove;

the shell, the locking mechanism, the decelerating mechanism, and the transmission part are connected through a connecting part; and the shell, the locking mechanism, the decelerating mechanism, the transmission part and the connecting part are arranged coaxially; and in a case that the transmission part drives the connecting part, the locking mechanism and the decelerating mechanism to rotate in a forward direction, the locking mechanism is configured to alternately lock and unlock the connecting part, and the decelerating mechanism is configured to limit a rotating speed of the connecting part; and in a case that the transmission part drives the connecting part, the locking mechanism and the decelerating mechanism to rotate in a reverse direction, the decelerating mechanism is configured to limit the rotating speed of the connecting part.

In an embodiment, the locking mechanism comprises a rotary sleeve, a locking shaft, a torsion spring, a sliding part and a latch assembly; the rotary sleeve and the locking shaft are slidably sleeved on an outer wall of the connecting part; the rotary sleeve is rotationally arranged in the first groove; a side wall of the first groove is provided with two first notches spaced from each other; the torsion spring is movably sleeved on the locking shaft; the locking shaft and the torsion spring are rotationally arranged in the rotary sleeve; a side wall of the rotary sleeve is provided with two second notches respectively corresponding to positions of the two first notches; a first end of the torsion spring is configured to pass through one of the two second notches to extend into one of the two first notches, and a second end of the torsion spring is configured to pass through the other of the two second notches to extend into the other of the two first notches; the first end of the torsion spring and the second end of the torsion spring are slidable respectively in the two second notches and the two first notches; the side wall of the first groove is provided with a sliding groove along a height direction; the sliding part is arranged in the sliding groove and is configured to slide in the sliding groove; the sliding part is connected with the rotary sleeve through the latch assembly; and the sliding part is configured to lock and unlock the latch assembly.

In an embodiment, a side of the sliding part close to the rotary sleeve is provided with an annular groove; a middle of the annular groove is provided with a third limiting block; a bottom surface of the annular groove is provided with a first curved surface, a second curved surface, a third curved surface and a fourth curved surface, and the first curved surface, the second curved surface, the third curved surface and the fourth curved surface are configured to form a step structure; and the third limiting block is provided with a clamping groove corresponding to the third curved surface.

In an embodiment, the latch assembly comprises a sliding rod and an elastic part; the side wall of the rotary sleeve is provided with a hole; a first end of the sliding rod is inserted into the hole, and a second end of the sliding rod is configured to always abut against the bottom surface of the annular groove and slide in the annular groove; the elastic part is arranged in the hole, and an end of the elastic part is connected with the sliding rod; and the elastic part is configured to apply a pushing force to the sliding rod to keep the sliding rod always abutting against the bottom surface of the annular groove.

In an embodiment, the locking shaft is connected with the transmission part through an adjusting assembly; and the adjusting assembly is configured to adjust a position state of the sliding rod in the annular groove.

In an embodiment, the adjusting assembly comprises a second limiting block and a fifth limiting block; the second limiting block is fixedly arranged on an end of the locking shaft close to the transmission part; a side of the transmission part close to the second limiting block is provided with a fifth groove; the second limiting block is configured to slide in the fifth groove; and the fifth limiting block is provided in the fifth groove.

In an embodiment, the decelerating mechanism comprises a rotary plate and a plurality of decelerating parts; the rotary plate is slidably sleeved on the outer wall of the connecting part; and the plurality of decelerating parts are rotatably arranged on an edge of the rotary plate.

In an embodiment, the number of the plurality of decelerating parts is at least two; and the plurality of decelerating parts are arranged on the edge of the rotary plate in a circular array.

In an embodiment, each of the plurality of decelerating parts comprises a decelerating block and a rotary shaft; the edge of the rotary plate is provided with a fourth notch, and the rotary shaft is movably inserted into the fourth notch; and the decelerating block is fixedly connected with a side wall of the rotary shaft.

This application also provides a reel, comprising the reel auxiliary device above.

This application has the following beneficial effects.

The reel auxiliary device provided herein is equipped with a locking mechanism and a decelerating mechanism, where the locking mechanism is configured such that the to-be-wound hose can be pulled and stopped at any time and can be kept at the pulled length without the pull force. The decelerating mechanism can cooperate with the locking mechanism to accurately control the pulled length of the hose, and can limit a winding speed of the hose during the retraction process, allowing for enhanced safety, multiple functions and improved user experience.

BRIEF DESCRIPTION OF THE DRAWINGS

In order to illustrate the technical solutions of this application or the prior art more clearly, the accompanying drawings required in the description of embodiments or the prior art will be briefly introduced below. It is obvious that the following accompanying drawings only show some embodiments of this application, and for those of ordinary skill in the art, other relevant accompanying drawings can also be obtained according to these drawings without making creative effort.

Figure 1:
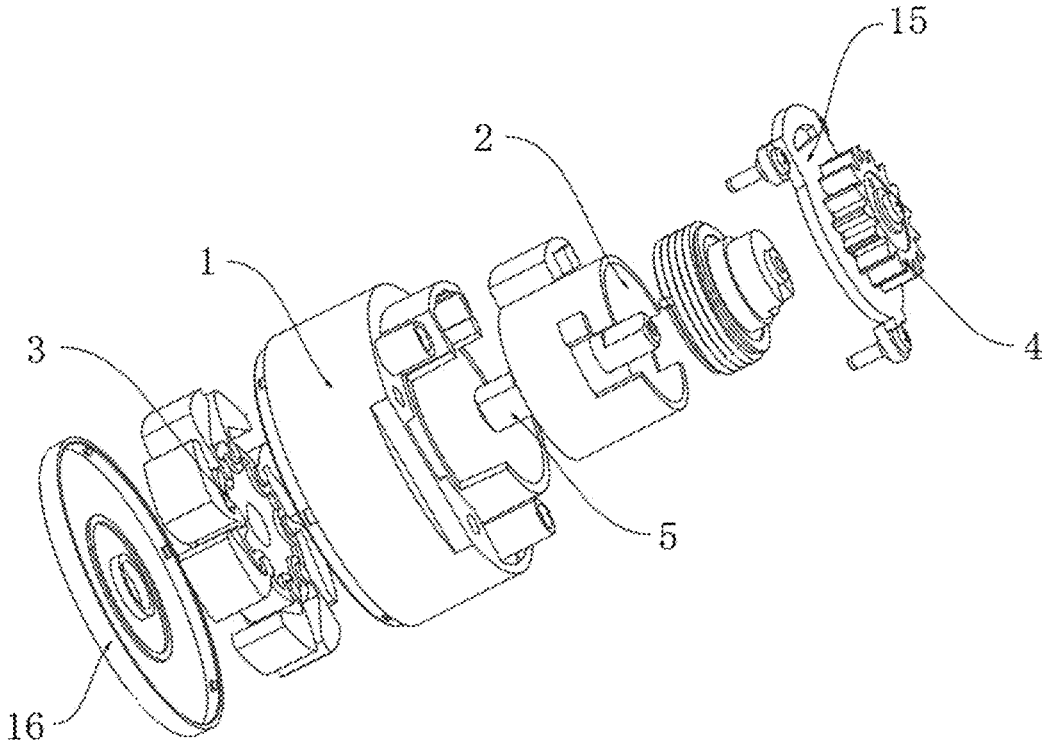
FIG. 1 is an exploded view of a reel auxiliary device according to an embodiment of the present disclosure.
Figure 2:
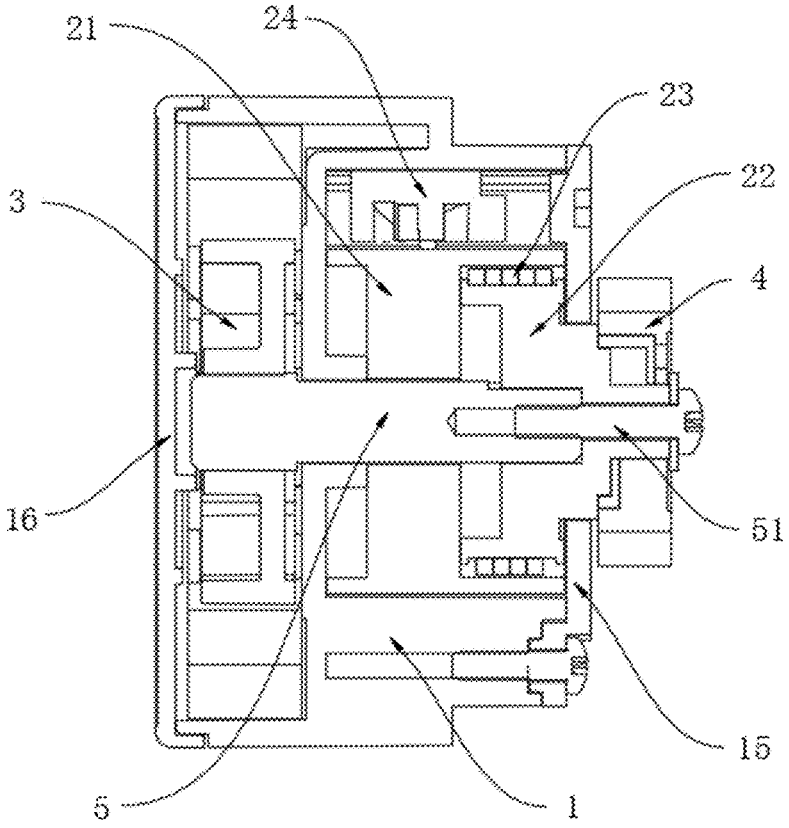
FIG. 2 schematically shows assembly of the reel auxiliary device according to an embodiment of the present disclosure.
Figure 3:
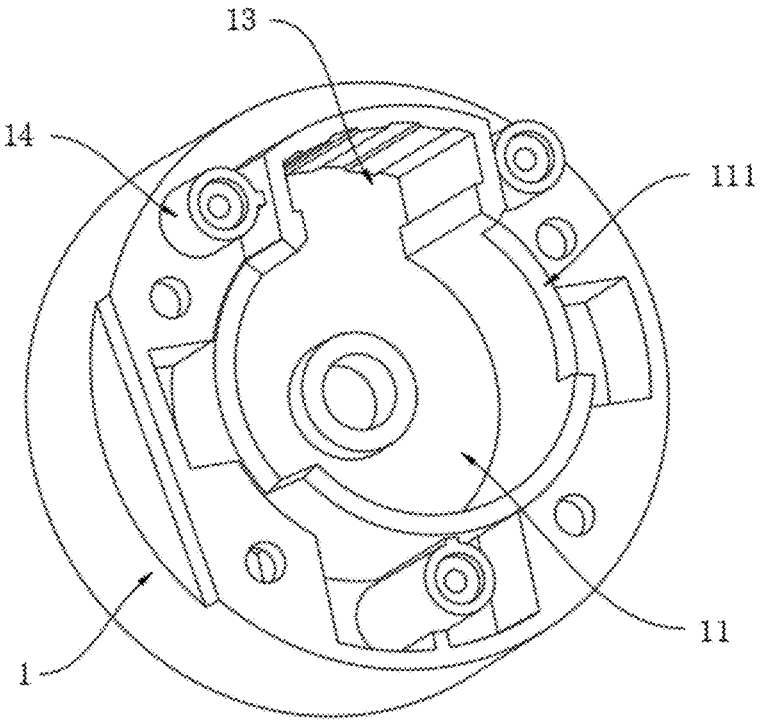
FIG. 3 is a right side view of a shell of the reel auxiliary device according to an embodiment of the present disclosure.
Figure 4:
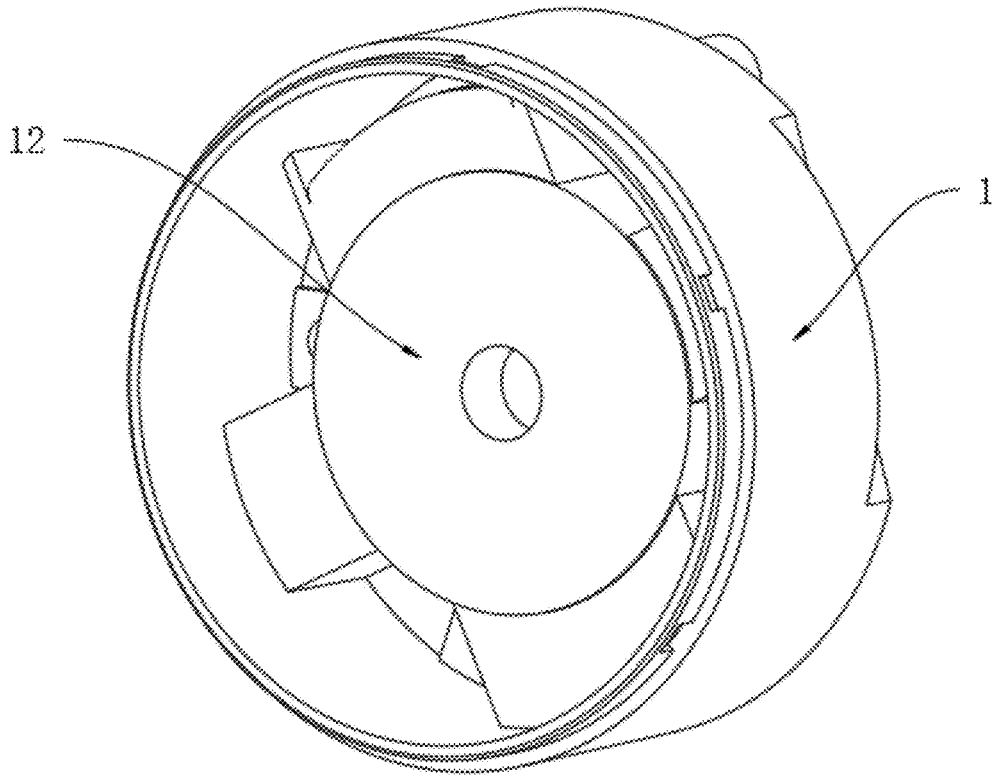
FIG. 4 is a left side view of the shell of the reel auxiliary device according to an embodiment of the present disclosure.
Figure 5:
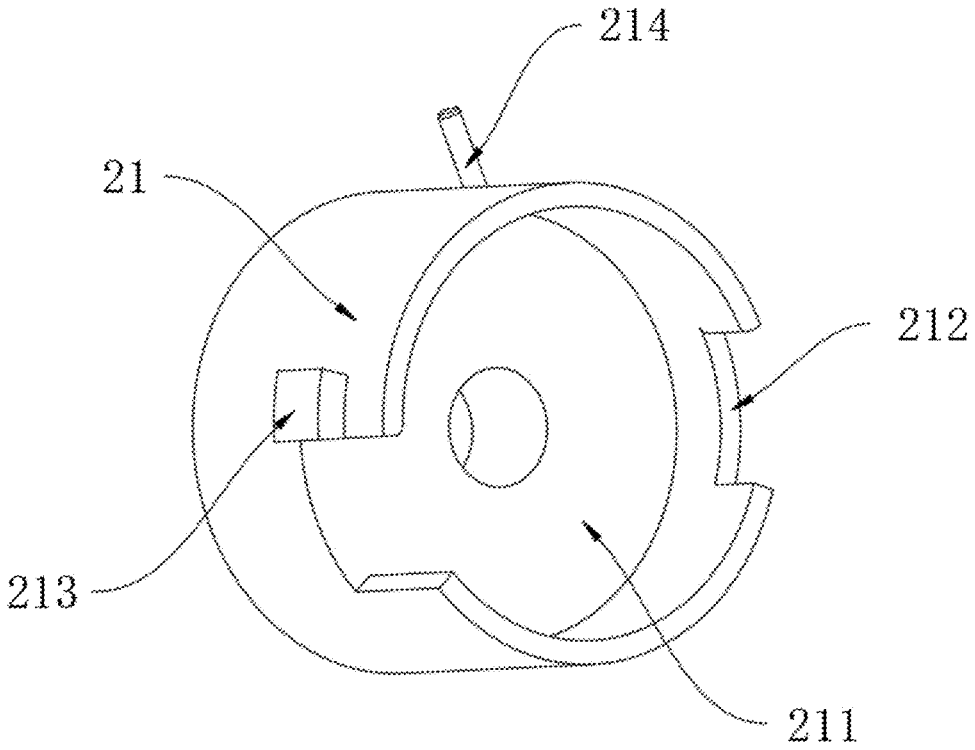
FIG. 5 structurally shows a rotary sleeve of a locking mechanism of the reel auxiliary device according to an embodiment of the present disclosure.
Figure 6:
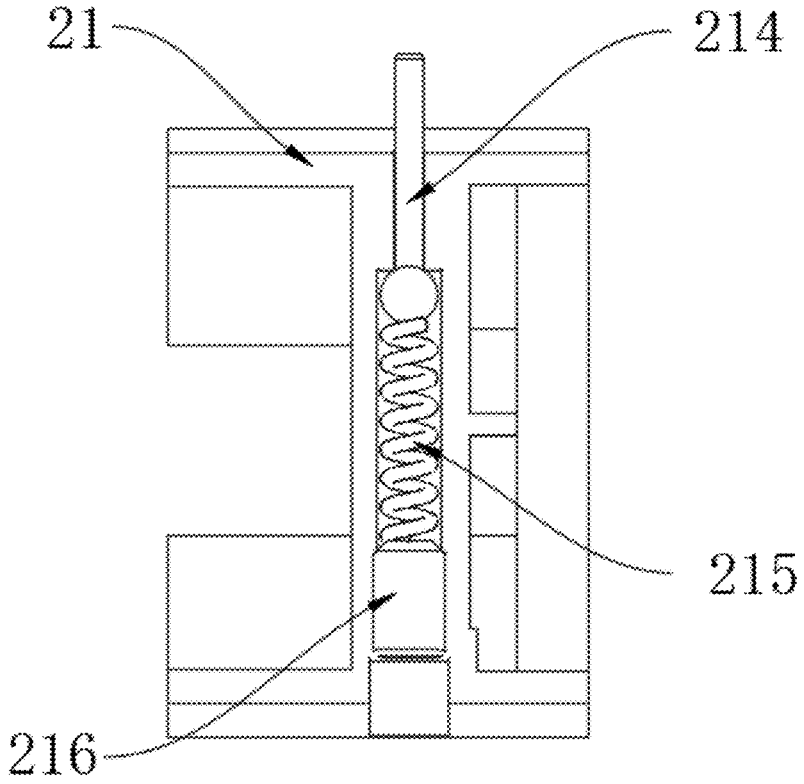
FIG. 6 is a cutaway view of the rotary sleeve according to an embodiment of the present disclosure.
Figure 7:
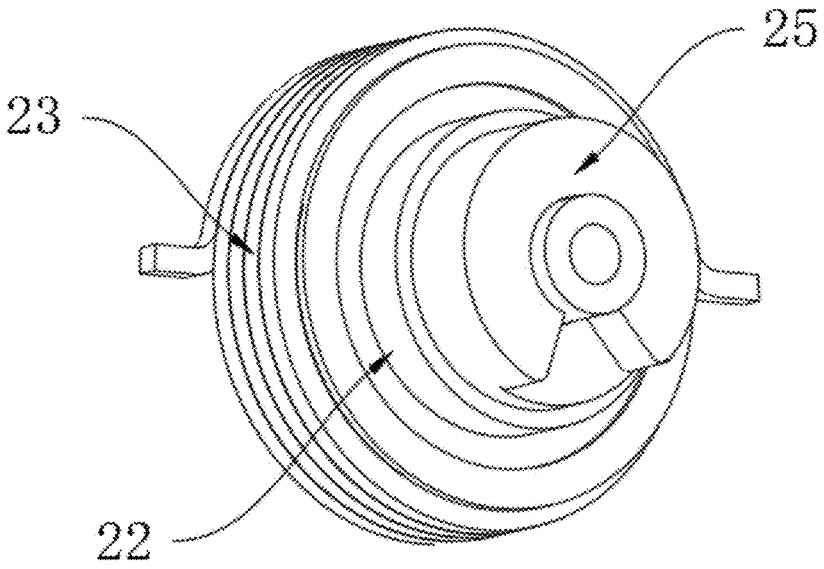
FIG. 7 schematically shows assembly of the locking mechanism according to an embodiment of the present disclosure.
Figure 8:
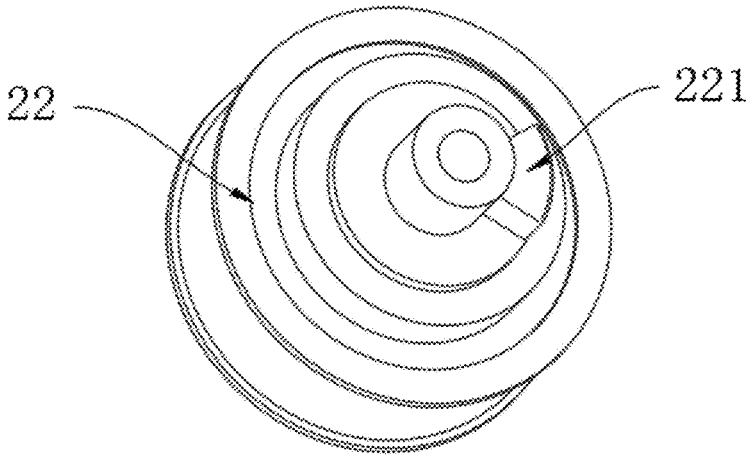
FIG. 8 structurally shows a locking shaft of the locking mechanism according to an embodiment of the present disclosure.
Figure 9:
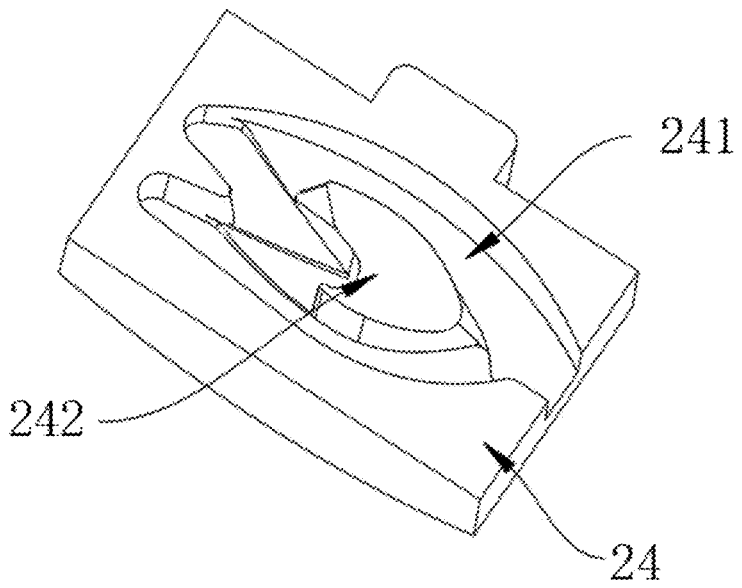
FIG. 9 schematically shows a sliding part of the locking mechanism according to an embodiment of the present disclosure.
Figure 10:
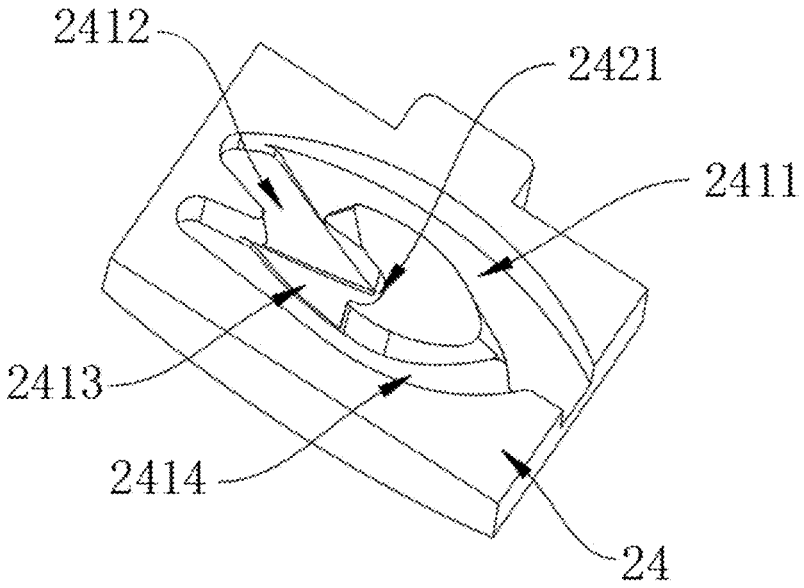
FIG. 10 schematically shows an interior structure of the sliding part according to an embodiment of the present disclosure.
Figure 11:
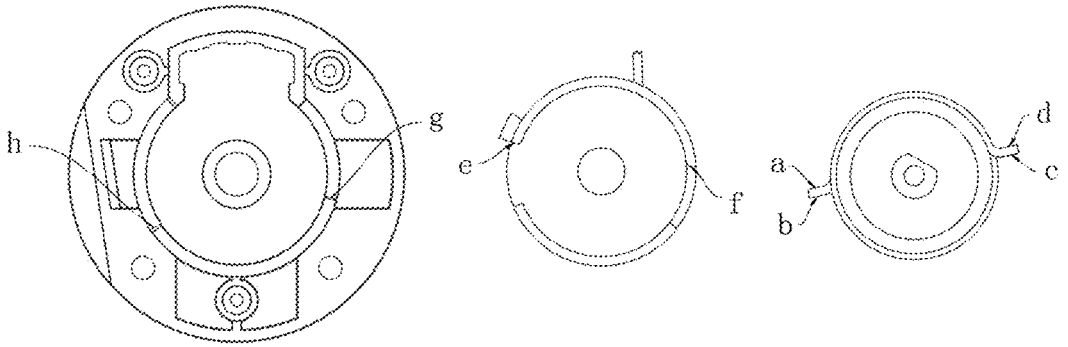
FIG. 11 schematically shows planar structure of the locking mechanism according to an embodiment of the present disclosure.

In the figures: 1, shell; 11, first groove; 111, first notch; 12, second groove; 13, sliding groove; 14, internally-threaded stud; 15, first cover; 16, second cover; 2, locking mechanism; 21, rotary sleeve; 211, third groove; 212, second notch; 213, first limiting block; 214, sliding rod; 215, elastic part; 216, bolt; 22, locking shaft; 221, second limiting block; 23, torsion spring; 24, sliding part; 241, annular groove; 2411, first curved surface; 2412, second curved surface; 2413, third curved surface; 2414, fourth curved surface; 242, third limiting block; 2421, clamping groove; 25, buffer part; 251, fourth groove; 252, fourth limiting block; 253, third notch; 3, decelerating mechanism; 31, rotary plate; 311, fourth notch; 32, decelerating part; 321, rotary shaft; 322, decelerating block; 323, clamping block; 4, transmission part; 41, fifth groove; 42, fifth limiting block; 5, connecting part; and 51, fastening nut.

DETAILED DESCRIPTION OF EMBODIMENTS

The technical solutions of the embodiments of the present disclosure will be clearly and completely described with reference to the accompanying drawings. It is obvious that described herein are only some embodiments of the present disclosure, rather than all embodiments. Based on the embodiments of the present disclosure, other embodiments obtained by those of ordinary skill in the art without making creative effort shall fall within the scope of the present disclosure.

It should be noted that the terms, such as "up", "down", "left", "right", "front", "rear" and other directional indications used herein, are only used for illustrating relative position relationship and motion between components in a specific state (as shown in the accompanying drawings). If the specific state changes, the directional indication accordingly changes.

In addition, the terms "first" and "second" are only used for distinguishment rather than indicating or implying the relative importance or implicitly specifying the number of technical features indicated. Therefore, a feature defined with "first" or "second" may explicitly or implicitly indicates the inclusion of at least one of such features. Besides, the term "and/or" used herein includes three solutions, for example, "A" and/or "B" includes solution "A", solution "B", and a combination thereof. Technical solutions of individual embodiments can be combined with each other as long as the combined solution can be implemented by those skilled in the art. When a combination of the technical solutions is contradictory or cannot be realized, it should be considered that such a combination does not exist, and is not within the scope of the present disclosure.

A reel auxiliary device of this application is mounted on an outer side of a support frame of a reel, and the reel includes a reel plate and the support frame. The reel auxiliary device is in drive connection with a gear of the reel through a transmission part.

The to-be-wound material of this application includes hoses for transmitting gas and liquid, electric wires and warning tapes.

Referring to FIGS. 1-4, a reel auxiliary device is provided, including a shell 1, a locking mechanism 2, a decelerating mechanism 3 and a transmission part 4.

A first side of the shell 1 is provided with a first groove 11, and a second side of the shell 1 is provided with a second groove 12. A first cover 15 is provided at an opening of the first groove 11, and a second cover 16 is provided at an opening of the second groove 12. The first cover 15 is connected with the first side of the shell 1, and the second cover 16 is connected with the second side of the shell 1.

The locking mechanism 2 is arranged in the first groove 11, and is configured to control locking of a reel.

The decelerating mechanism 3 is arranged in the second groove 12, and is configured to reduce a rotating speed of the reel.

The transmission part 4 is arranged on a side of the first cover 15 away from the first groove 11, and is rotationally connected with the first cover 15.

The shell 1, the locking mechanism 2, the decelerating mechanism 3, and the transmission part 4 are connected through a connecting part 5, and the shell 1, the locking mechanism 2, the decelerating mechanism 3, the transmission part 4 and the connecting part 5 are arranged coaxially.

In a case that the transmission part 4 drives the connecting part 5, the locking mechanism 2 and the decelerating mechanism 3 to rotate in a forward direction, the locking mechanism 2 is configured to alternately lock and unlock the connecting part 5, and the decelerating mechanism 3 is configured to limit a rotating speed of the connecting part 5. In a case that the transmission part 4 drives the connecting part 5, the locking mechanism 2 and the decelerating mechanism 3 to rotate in a reverse direction, the decelerating mechanism 3 is configured to limit the rotating speed of the connecting part 5.

In this embodiment, the shell 1 is provided with an internally-threaded stud 14. The first cover 15 is in fastening connection with the internally-threaded stud 14. The second cover 16 is in snap connection or thread connection with the shell 1. An end of the connecting part 5 close to the transmission part 4 is provided with an internal thread, and is in thread connection with a fastening nut 51. An axis of the transmission part 4 is provided with a first through hole. The fastening nut 51 is configured to pass through the transmission part 4 to enter an interior of the shell 1 to be connected with the connecting part 5. In an embodiment, the transmission part 4 is a gear or a friction gear.

The shell 1, the locking mechanism 2, the decelerating mechanism 3, the transmission part 4 and the connecting part 5 are arranged coaxially. In a case that the to-be-wound material is pulled outward, the reel rotates clockwise, and a gear of the reel drives the transmission part 4 to rotate synchronously. The transmission part 4 drives the connecting part 5 to rotate, and the connecting part 5 drives the locking mechanism 2 and the decelerating mechanism 3 to rotate synchronously. In a process of pulling the to-be-wound material, the locking mechanism will continue to alternately lock and unlock the connecting part 5. After the to-be-wound material is pulled to a pulled length, in a case that the locking mechanism 2 performs a locking operation, the locking mechanism 2 will keep the to-be-wound material at the pulled length, so that the to-be-wound material can be stopped at any time and can be kept at the pulled length without a pull force; and in the case that the locking mechanism 2 performs an unlocking operation, the to-be-wound material will be retracted immediately.

If the pulling speed of the to-be-wound material is too large, which causes the connecting part 5 to rotate too fast, the decelerating mechanism 3 will decelerate the rotating speed of the connecting part 5 to reduce the pulling speed of the to-be-wound material, and the locking mechanism 2 can make the to-be-wound material be pulled or stopped at any time, so as to accurately control the pulled length.

In a case that the to-be-wound material is retracted, the reel rotates counterclockwise. At this time, the locking mechanism does not perform the locking operation and the unlocking operation, and the decelerating mechanism 3 will reduce the rotating speed of the connecting part 5 if the rotating speed of the connecting part 5 is too fast during a retracting process, so as to reduce a winding speed of the to-be-wound material, and avoid irregular swinging and damage to surrounding operators and objects caused by fast winding speed of an end of the to-be-wound material, improving the safety of the reel.

The locking mechanism 2 is provided, and is configured to realize that the to-be-wound material can be pulled and stopped at any time and can be kept in the pulled length without the pull force. The decelerating mechanism 3 is configured to cooperate with the locking mechanism 2 to accurately control the pulled length of the to-be-wound material, and is configured to limit the winding speed of the to-be-wound material when the to-be-wound material is retracted, allowing for enhanced safety, multiple functions and improved user experience.

Referring to FIGS. 5-11, in an embodiment, the locking mechanism 2 includes a rotary sleeve 21, a locking shaft 22, a torsion spring 23, a sliding part 24 and a latch assembly. The rotary sleeve 21 and the locking shaft 22 are slidably sleeved on an outer wall of the connecting part 5. The rotary sleeve 21 is rotationally arranged in the first groove 11. A side wall of the first groove 11 is provided with two first notches 111 spaced from each other. The torsion spring 23 is movably sleeved on the locking shaft 22. The rotary sleeve 21 is provided with a third groove 211. The locking shaft 22 and the torsion spring 23 are rotationally arranged in the third groove 211. A side wall of the rotary sleeve 21 is provided with two second notches 212 respectively corresponding to the two first notches 111. A first end of the torsion spring 23 is configured to pass through one of the two second notches 212 to extend into one of the two first notches 111, and a second end of the torsion spring 23 is configured to pass through the other of the two second notches 212 to extend into the other of the two first notches 111. The first end and the second end of the torsion spring 23 are slidable respectively in the two second notches 212 and the two first notches 111. The side wall of the first groove 11 is provided with a sliding groove 13 along a height direction. The sliding part 24 is arranged in the sliding groove 13, and is configured to slide in the sliding groove 13. The sliding part 24 is connected with the rotary sleeve 21 through the latch assembly, the sliding part 24 is configured to lock and unlock the latch assembly.

In this embodiment, in a case that the to-be-wound material is pulled outward, the reel drives the transmission part 4 to rotate clockwise, and the transmission part 4 drives the connecting part 5 and the locking shaft 22 to rotate synchronously, so that the locking shaft 22 drives the torsion spring 23 to rotate synchronously to make the torsion spring 23 slide in the two first notches 111 and the two second notches 212. When an a-side of a first end of the torsion spring 23 is in contact of an e-side of the one of the two second notches 212, the a-side of the first end of the torsion spring 23 is forced, and the torsion spring 23 will retract to tighten the locking shaft 22. The locking shaft 22 rotates to synchronously drive the torsion spring 23 to rotate, so as to drive the rotary sleeve 21 and the latch assembly to rotate, and then the latch assembly slides on the sliding part 24, and slides to a rightmost end of the sliding part 24.

As the locking shaft 22, the torsion spring 23, the rotary sleeve 21 continue to rotate, when a c-side of a second end of the torsion spring 23 is in contact of a g-side of the one of the two first notches 111 of the shell 1, the c-side of the second end of the torsion spring 23 is forced, and the torsion spring 23 will untighten the locking shaft 22. At this time, the torsion spring 23 and the rotary sleeve 21 stop rotating, but the locking shaft 22 will continue to rotate. At this time, the to-be-wound material can be continuously pulled outward from the reel.

After the to-be-wound material is pulled outward to reach a required length, the pulling operation is stopped, and the to-be-wound material is released. At this time, under the action of a restoring force, the reel rotates counterclockwise to retract the to-be-wound material, and the transmission part 4, the connecting part 5 and the locking shaft 22 are driven to rotate synchronously. The locking shaft 22 drives the torsion spring 23 to rotate counterclockwise. At this time, a d-side of the second end of the torsion spring 23 is in contact with a f-side of the other one of the two second notches 212, the d-side of the second end of the torsion spring 23 is forced, and the torsion spring 23 will retract to tighten the locking shaft 22. The locking shaft 22 rotates to drive the torsion spring 23 and the latch assembly to rotate, and synchronously drive the rotary sleeve 21 to rotate reversely, so that the latch assembly slides left on the sliding part 24, then the latch assembly will be clamped and locked by a sliding block. At this time, the rotary sleeve 21, the torsion spring 23 and the locking shaft 22 stop rotating, therefore the connecting part 5 and the transmission part 4 stop rotating, so as to keep the to-be-wound material at the required length, thereby realizing a locking effect.

When it is needed to unlock, the to-be-wound material continues to be pulled out. At this time, the rotary sleeve 21 drives the latch assembly to separate from the sliding part 24 to unlock.

In a whole process of pulling the to-be-wound material, the locking process and the unlocking process will be performed alternately, so as to realize that the to-be-wound material can be pulled and stopped at any time.

After unlocking, the to-be-wound material is retracted. The reel drives the transmission part 4 to rotate counterclockwise, and synchronously drives the connecting part 5 and the locking shaft 22 to rotate. The locking shaft 22 drives the torsion spring 23 to rotate counterclockwise. At this time, the d-side of the second end of the torsion spring 23 is in contact with the f-side of the other one of the two second notches 212, the d-side is forced, and the torsion spring 23 will retract to tighten the locking shaft 22. The locking shaft 22 rotates to drive the torsion spring 23 to rotate. The torsion spring 23 rotates to drive the rotary sleeve 21 to rotate synchronously and drive the latch assembly to slide to a leftmost end of the sliding part 24.

As the locking shaft 22, the torsion spring 23 and the rotary sleeve 21 continue to rotate, a b-side of the first end of the torsion spring 23 is in contact of the g-side the one of the two first notches 111. The b-side of the first end of the torsion spring 23 is forced, and the f-side of the other one of the two second notches 212 is not forced because the latch assembly does not abut against the leftmost end of the sliding part 24. At this time, the torsion spring 23 is in an untightening state, and the torsion spring 23 and the rotary sleeve 21 stop rotating. The locking shaft 22 will continue to rotate reversely, and the to-be-wound material continues to be retracted in the reel.

In addition, when the latch assembly slides on the sliding part 24, the sliding part 24 synchronously perform reciprocating sliding in the sliding groove 13 for automatic adaptation.

In an embodiment, the side wall of the rotary sleeve 21 is also provided with a first limiting block 213. The first limiting block 213 is configured to slide in the corresponding first notch 111.

In this embodiment, the first limiting block 213 is provided to ensure the f-side of the other one of the two second notches 212 of the rotary sleeve 21 to keep a certain distance from the g-side of the one of the two first notches 111 of the shell 1, and the torsion spring 23 will not be clamped in the rotating process.

The first cover 15 is provided with a second through hole, which is configured to fit an end of the first cover 15 close to the locking shaft 22.

In an embodiment, a side of the sliding part 24 close to the rotary sleeve 21 is provided with an annular groove 241. A middle of the annular groove 241 is provided with a third limiting block 242. A bottom surface of the annular groove 241 is provided with a first curved surface 2411, a second curved surface 2412, a third curved surface 2413 and a fourth curved surface 2414, and the first curved surface 2411, the second curved surface 2412, the third curved surface 2413 and the fourth curved surface 2414 are configured to form a step structure. The third limiting block 242 is provided with a clamping groove 2421 corresponding to the third curved surface 2413.

In this embodiment, the first curved surface 2411, the second curved surface 2412, the third curved surface 2413 and the fourth curved surface 2414 are connected end to end to form an angular structure, where the first curved surface 2411 is higher than the second curved surface 2412 at a connection of the first curved surface 2411 and the second curved surface 2412; the second curved surface 2412 is higher than the third curved surface 2413 at a connection of the second curved surface 2412 and the third curved surface 2413; the third curved surface 2413 is higher than the fourth curved surface 2414 at a connection of the third curved surface 2413 and the fourth curved surface 2414; and the fourth curved surface 2414 is higher than first curved surface 2411 at a connection of the fourth curved surface 2414 and first curved surface 2411.

The latch assembly slides left from the first curved surface 2411 until it is close to a leftmost end of the first curved surface 2411 and falls into the second curved surface 2412. Owing to a height difference between the first curved surface 2411 and the second curved surface 2412, the latch assembly will not return to the first curved surface 2411, and can only slides left along the second curved surface 2412 to the third curved surface 2413. In such arrangement, the latch assembly can only circulate to slide in a direction from the first curved surface 2411 to the fourth curved surface 2414 in the annular groove 241.

In a sliding process of the latch assembly from the first curved surface 2411 to the fourth curved surface 2414, the rotary sleeve 21 is in a counterclockwise rotation state; and in a sliding process of the latch assembly from the fourth curved surface 2414 to the first curved surface 2411, the rotary sleeve 21 is in a clockwise rotation state.

In a case that the locking operation is performed, the latch assembly is configured to enter the clamping groove 2421 from the third curved surface 2413 and be clamped. At this time, the rotary sleeve 21, the torsion spring 23 and the locking shaft stop rotating, so that the connecting part 5 and the transmission part 4 stop rotating to realize the locking effect. In a case that the unlocking operation is performed, the latch assembly is configured to slide left to separate from the clamping groove 2421 and fall into the fourth curved surface 2414. At this time, the latch assembly is configured to slide right to enter the first curved surface 2411, so as to complete unlocking.

In a whole process of pulling the to-be-wound material, the locking process and the unlocking process will be performed alternately, so as to realize that the to-be-wound material can be pulled and stopped at any time, and can be kept in the required length the pull force.

When the to-be-wound material is retracted, the latch assembly slides to the leftmost end of the sliding part 24, and the latch assembly does not slide into the clamping groove 2421. At this time, the rotary sleeve 21 and the torsion spring 23 stop rotating, and the locking shaft 22, the connecting part 5 and the transmission part continue to rotate, so as to drive the reel to retract the to-be-wound material.

In an embodiment, the latch assembly includes a sliding rod 214 and an elastic part 215. The side wall of the rotary sleeve 21 is provided with a hole. A first end of the sliding rod 214 is inserted into the hole, and a second end of the sliding rod 214 is configured to always abut against the bottom surface of the annular groove 241 and slide in the annular groove 241. The elastic part 215 is arranged in the hole, and a first end of the elastic part 215 is connected with the sliding rod 214. The elastic part 215 is configured to apply a pushing force to the sliding rod 214 to keep the sliding rod 214 always abutting against the bottom surface of the annular groove 241.

In this embodiment, the hole on the rotary sleeve 21 is a blind hole. The elastic part 215 is configured to keep the sliding rod 214 always abutting against the bottom surface of the annular groove 241, so that the sliding rod 214 will not be separated from the sliding part 24, avoiding the failure of switch function between locking and unlocking due to the unreliable step transition caused by a gap.

In an embodiment, the hole on the rotary sleeve 21 is a through hole. The latch assembly further includes a bolt 216. At this time, a second end of the elastic part 215 abuts against the bolt 216, and the bolt 216 is in threaded connection with an inner wall of the through hole of the rotary sleeve 21. The bolt 216 is configured to fix the second end of the elastic part 215 and apply a pushing force to the sliding rod 214. At the same time, the threaded connection makes the removal and mounting of the sliding rod 214 convenient.

The sliding rod 214 is arranged on an off-center position of the rotary, avoiding the connecting part 5.

In an embodiment, the elastic part 215 is a spring.

Figure 12:
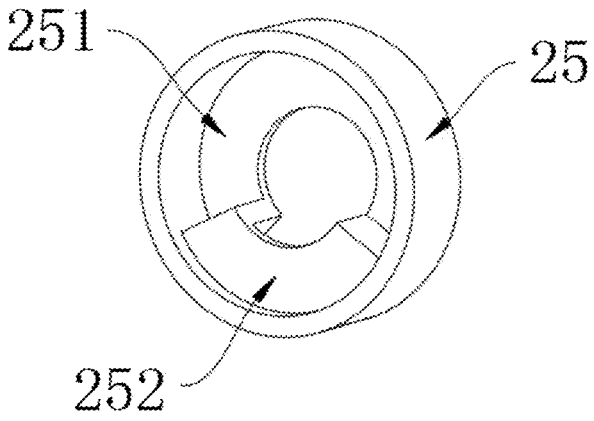
FIG. 12 schematically shows an interior structure of a buffer part of the locking mechanism according to an embodiment of the present disclosure.
Figure 13:
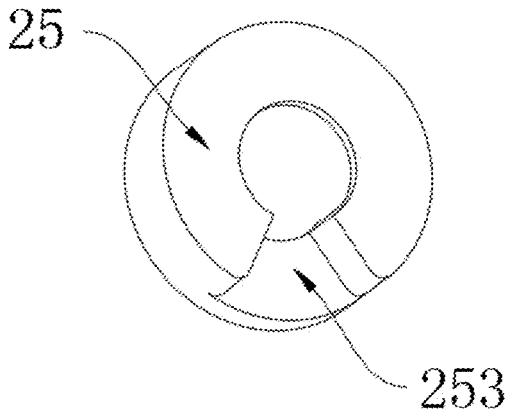
FIG. 13 schematically shows a structure of the buffer part according to an embodiment of the present disclosure.
Figure 14:
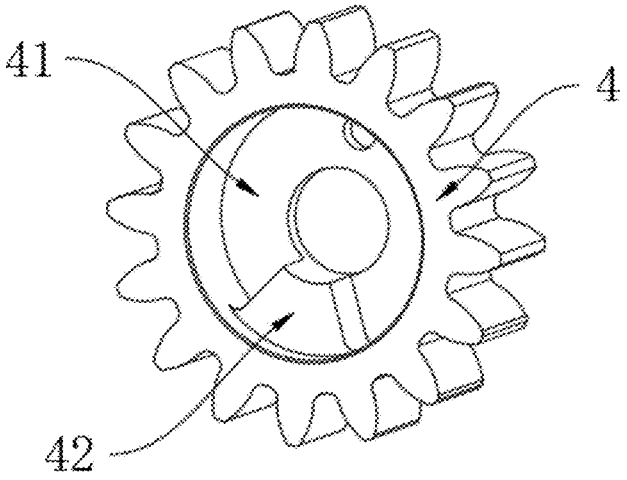
FIG. 14 schematically shows a structure of a transmission part according to an embodiment of the present disclosure.

Referring to FIGS. 12-14, in an embodiment, the locking shaft 22 is connected with the transmission part 4 through an adjusting assembly. The adjusting assembly is configured to adjust a position state of the sliding rod 214 in the annular groove 241.

In this embodiment, the locking and unlocking of the locking mechanism 2 requires the to-be-wound material to be pulled out a certain distance to switch the position state of the sliding rod 214 in the annular groove 241, and the adjusting assembly is configured for the to-be-wound material can be pulled at any time.

In an embodiment, when the to-be-wound material is fully pulled out, and finally a state that the to-be-wound material cannot be pulled is reached, the pulling speed of the to-be-wound material is still relatively large, and due to the inertia, the reel will still rotate in the forward direction at an angle. If the locking mechanism is in a locking state at this time, there is no space for the to-be-wound material to be pulled, and thus the locking mechanism cannot perform the unlocking operation, such that the to-be-wound material cannot be retracted normally. In view of this, the transmission part 4 is configured to rotate relative to the locking shaft 22, and is required to rotate at an angle to eliminate the gap before locking. At this time, the reel will also rotate in a reverse direction at an angle, and then the locking operation is performed, so as to avoid the situation that the to-be-wound material cannot be retracted after it is completely pulled out.

In an embodiment, the adjusting assembly includes a second limiting block 221 and a fifth limiting block 42. The second limiting block 221 is fixedly arranged on an end of the locking shaft 22 close to the transmission part 4. An end of the transmission part 4 close to the second limiting block 221 is provided with a fifth groove 41. The second limiting block 221 is configured to slide in the fifth groove 41. The fifth limiting block 42 is provided in the fifth groove 41.

In this embodiment, the gear of the reel drives the transmission part 4 to rotate, and the transmission part 4 drives the fifth limiting block 42 rotate synchronously. At this time, the second limiting block 221 also slides in the fifth groove 41, and the second limiting block 221 and the fifth limiting block 42 are close to each other. When the second limiting block 221 is in contact with the fifth limiting block 42, the second limiting block 221 and the fifth limiting block 42 are clamped with each other. At this time, the transmission part 4 rotates to drive the locking shaft 22 to rotate synchronously.

In this arrangement, when the to-be-wound material has no room to be pulled and the locking mechanism is in the locking state, it only needs to make the transmission part 4 rotate reversely to drive the fifth limiting block 42 away from the second limiting block 221. At this time, the reel will rotate in the reverse direction at the third angle and then the locking operation is performed, so as to always reserve a certain rotating angle for unlocking, avoiding the situation that the to-be-wound material cannot be retracted due to the to-be-wound material is pulled to its end, is locked and finally cannot be pulled.

In an embodiment, a buffer part 25 is provided between the transmission part 4 and the locking shaft 22. The buffer part 25 is sleevedly provided in the fifth groove 41. The buffer part 25 includes a fourth groove 251, a fourth limiting block 252 and a third notch 253. The fourth groove 251 is arranged on a first side of the buffer part 25 close to the locking shaft 22. The second limiting block 221 is configured to slide in the fourth groove 251. The fourth limiting block 252 is arranged in the fourth groove 251. The third notch 253 is arranged on a second side of the buffer part 25 corresponding to the fourth limiting block 252. The third notch 253 is configured to match to the fifth limiting block 42, and the fifth limiting block 42 is inserted into the third notch 253.

In this embodiment, the buffer part 25 is configured to completely wrap the fifth groove 41 and the fifth limiting block 42. When the second limiting block 221 slides in the fourth groove 251 and impacts the fifth limiting block 42, the buffer part 25 is configured to protect the second limiting block 221 and the fifth limiting block 42 for buffering and reducing impact force.

In an embodiment, the buffer part 25 is made of a nylon material.

Figure 15:
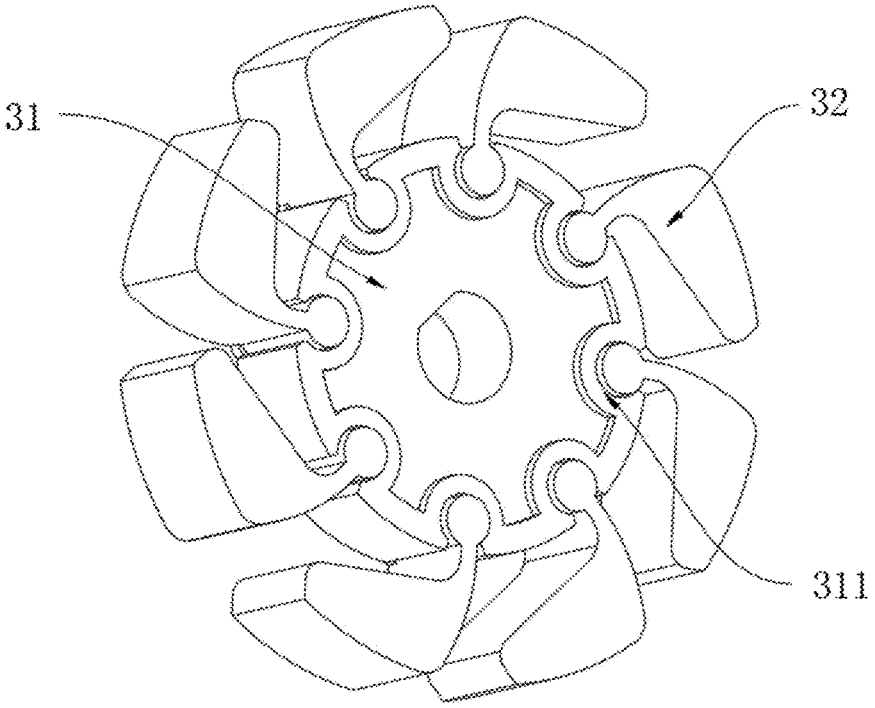
FIG. 15 schematically shows a structure of a decelerating mechanism according to an embodiment of the present disclosure.
Figure 16:
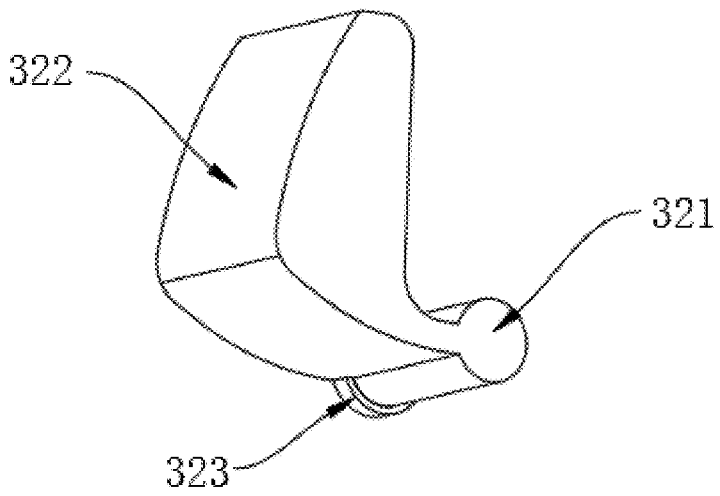
FIG. 16 structurally shows a decelerating part of the decelerating mechanism according to an embodiment of the present disclosure.

Referring to FIGS. 15-16, in an embodiment, the decelerating mechanism 3 includes a rotary plate 31 and a plurality of decelerating parts 32. The rotary plate 31 is slidably provided on the outer wall of the connecting part 5. The plurality of decelerating parts 32 are rotatably arranged on an edge of the rotary plate 31.

In this embodiment, the rotary plate 31 can only slide on the connecting part 5, and cannot perform self-rotation. When the connecting part 5 drives the rotary plate 31 to rotate and the rotary plate 31 has a large rotating speed, under the action of a centrifugal force, the plurality of decelerating parts 32 will open towards a direction away from the rotary plate 31, be in contact with a side wall of the second groove 12 of the shell 1, and slide on the side wall of the second groove 12. At this time, under the action of a friction, a sliding speed of the plurality of decelerating parts 32 in the side wall of the second groove 12 is reduced, resulting in reducing rotating speeds of the rotary plate 31, the connecting part 5 and the transmission part 4, so as to realize that a pulling speed and a winding speed of the to-be-wound material are limited.

In an embodiment, the number of the plurality of decelerating parts 32 is at least two, and the plurality of decelerating parts 32 are arranged on the edge of the rotary plate 31 in a circular array.

In this embodiment, the number of the plurality of decelerating parts 32 can be selected according to demands. The plurality of decelerating parts 32 are arranged on the edge of the rotary plate 31 in the circular array, which can improve a stability of the rotary plate 31.

In an embodiment, each of the plurality of decelerating parts 32 includes a decelerating block 322 and a rotary shaft 321. The edge of the rotary plate 31 is provided with a fourth notch 311, and the rotary shaft 321 is movably inserted into the fourth notch 311. The decelerating block 322 is fixedly connected with a side wall of the rotary shaft 321.

In this embodiment, under the action of the centrifugal force, when the decelerating block 322 is opened in the direction away from the rotary plate 31 and is closed in a direction close to the rotary plate 31, the rotary shaft 321 will be driven to rotate in the fourth notch 311.

In an embodiment, a center of gravity of the decelerating block 322 is in an offset arrangement in a plane where an axis of the rotary plate 31 and an axis of the rotary shaft 321 are located.

In this embodiment, the center of gravity of the decelerating block 322 is in the offset arrangement in the plane where the axis of the rotary plate 31 and the axis of the rotary shaft 321 are located. In a case that the rotary plate 31 rotates towards a direction opposite to an offset direction, the decelerating block 322 will close. In a case that the decelerating block 322 rotates towards the direction opposite to the offset direction, under the action of the centrifugal force, the decelerating block 322 will open.

In an embodiment, an end of the rotary shaft 321 is provided with a clamping block 323.

In this embodiment, the end of the rotary shaft 321 is provided with a clamping block 323 to avoid that the rotary shaft 321 sliding in the fourth notch 311 when the rotary plate 31 is rotating at a high speed.

An operating principle of the reel auxiliary device is described as follows.

When the to-be-wound material is pulled out for a first time, the sliding part 24, the latch assembly, the rotary sleeve 21 and the torsion spring 23 in the locking mechanism 2 will not limit a rotation of the locking shaft 22, thereby not limiting a rotation of the reel. At this time, the to-be-wound material can be continuously pulled out. In the case of an excessive rotation speed of the reel caused by a large pulling speed the decelerating block 322 of the decelerating mechanism 3 will be in contact with an inner wall of the second groove 12 of the shell 1, and slide on the inner wall of the second groove 12 under the action of the centrifugal force. The rotating speed of the connecting part 5 is also reduced under the action of friction, so as to reduce the rotating speed of the reel.

When the to-be-wound material is pulled out at the pulled length and then released, the reel rotates reversely, and the latch assembly slides into the clamping groove 2421 and is locked and clamped. At this time, the rotary sleeve 21, the torsion spring 23, the locking shaft 22, the connecting part 5 and the transmission part 4 stop rotating, and the reel stop rotating, so as to keep the to-be-wound material at the pulled length.

When the to-be-wound material needs to be retracted, the to-be-wound material only needs to be pulled out again and then released, and the latch assembly will separate from the clamping groove 2421. At this time, the reel is unlocked, and the to-be-wound material will be retracted to the reel after releasing. During the retraction process, if the rotating speed of the reel is too fast due to the to-be-wound material is retracted too fast, the decelerating block 322 of the decelerating mechanism 3 is in contact with the inner wall of the second groove 12 of the shell 1 and slides in the inner wall of the second groove 12 under the action of the centrifugal force. The rotating speed of the reel is reduced under the action of a friction.

The above steps are repeated to realize that the to-be-wound material can be pulled and stopped at any time, and can be kept at the pulled length without the pull force. In addition, a safe retraction of the to-be-wound material can also be realized.

This application also provides a reel, including the reel auxiliary device above.

Described above are only preferred embodiments of the present disclosure, which are not intended to limit the disclosure. Under the sprits of this application, any equivalent replacements or direct/indirect application in other arts by utilizing the specification and accompanying drawings of this application shall fall within the scope of this application defined by the appended claims.

What is claimed is:

1. A reel auxiliary device, comprising:

a shell;

a locking mechanism;

a decelerating mechanism; and a transmission part;

wherein a first side of the shell is provided with a first groove, and a second side of the shell is provided with a second groove; a first cover is provided at an opening of the first groove, and a second cover is provided at an opening of the second groove; and the first cover is connected with the first side of the shell, and the second cover is connected with the second side of the shell;

the locking mechanism is arranged in the first groove, and is configured to control locking of a reel;

the decelerating mechanism is arranged in the second groove, and is configured to reduce a rotating speed of the reel;

the transmission part is arranged on a side of the first cover away from the first groove;

the shell, the locking mechanism, the decelerating mechanism, and the transmission part are connected through a connecting part; and the shell, the locking mechanism, the decelerating mechanism, the transmission part and the connecting part are arranged coaxially; and in a case that the transmission part drives the connecting part, the locking mechanism and the decelerating mechanism to rotate in a forward direction, the locking mechanism is configured to alternately lock and unlock the connecting part, and the decelerating mechanism is configured to limit a rotating speed of the connecting part; and in a case that the transmission part drives the connecting part, the locking mechanism and the decelerating mechanism to rotate in a reverse direction, the decelerating mechanism is configured to limit the rotating speed of the connecting part.

2. The reel auxiliary device of claim 1, wherein the locking mechanism comprises a rotary sleeve, a locking shaft, a torsion spring, a sliding part and a latch assembly; the rotary sleeve and the locking shaft are slidably sleeved on an outer wall of the connecting part; the rotary sleeve is rotationally arranged in the first groove; a side wall of the first groove is provided with two first notches spaced from each other; the torsion spring is movably sleeved on the locking shaft; the locking shaft and the torsion spring are rotationally arranged in the rotary sleeve; a side wall of the rotary sleeve is provided with two second notches respectively corresponding to the two first notches; a first end of the torsion spring is configured to pass through one of the two second notches to extend into one of the two first notches, and a second end of the torsion spring is configured to pass through the other of the two second notches to extend into the other of the two first notches; the first end of the torsion spring and the second end of the torsion spring are slidable respectively in the two second notches and the two first notches; the side wall of the first groove is provided with a sliding groove along a height direction; the sliding part is arranged in the sliding groove, and is configured to slide in the sliding groove; the sliding part is connected with the rotary sleeve through the latch assembly; and the sliding part is configured to lock and unlock the latch assembly.

3. The reel auxiliary device of claim 2, wherein a side of the sliding part close to the rotary sleeve is provided with an annular groove; a middle of the annular groove is provided with a first limiting block; a bottom surface of the annular groove is provided with a first curved surface, a second curved surface, a third curved surface and a fourth curved surface, and the first curved surface, the second curved surface, the third curved surface and the fourth curved surface are configured to form a step structure; and the first limiting block is provided with a clamping groove corresponding to the third curved surface.

4. The reel auxiliary device of claim 3, wherein the latch assembly comprises a sliding rod and an elastic part; the side wall of the rotary sleeve is provided with a hole; a first end of the sliding rod is inserted into the hole, and a second end of the sliding rod is configured to always abut against the bottom surface of the annular groove and slide in the annular groove; the elastic part is arranged in the hole, and an end of the elastic part is connected with the sliding rod; and the elastic part is configured to apply a pushing force to the sliding rod to keep the sliding rod always abutting against the bottom surface of the annular groove.

5. The reel auxiliary device of claim 4, wherein the locking shaft is connected with the transmission part through an adjusting assembly; and the adjusting assembly is configured to adjust a position state of the sliding rod in the annular groove.

6. The reel auxiliary device of claim 5, wherein the adjusting assembly comprises a second limiting block and a third limiting block; the second limiting block is fixedly arranged on an end of the locking shaft close to the transmission part; a side of the transmission part close to the second limiting block is provided with a third groove; the second limiting block is configured to slide in the third groove; and the third limiting block is provided in the third groove.

7. The reel auxiliary device of claim 2, wherein the decelerating mechanism comprises a rotary plate and a plurality of decelerating parts; the rotary plate is slidably sleeved on the outer wall of the connecting part; and the plurality of decelerating parts are rotatably arranged on an edge of the rotary plate.

8. The reel auxiliary device of claim 7, wherein the number of the plurality of decelerating parts is at least two; and the plurality of decelerating parts are arranged on the edge of the rotary plate in a circular array.

9. The reel auxiliary device of claim 8, wherein each of the plurality of decelerating parts comprises a decelerating block and a rotary shaft; the edge of the rotary plate is provided with a third notch, and the rotary shaft is movably inserted into the third notch; and the decelerating block is fixedly connected with a side wall of the rotary shaft.

10. A reel, comprising:

the reel auxiliary device of claim 1.

* * * * *